United States Patent [19]

Blanton

[11] 4,210,214

[45] Jul. 1, 1980

[54] TEMPERATURE COMPENSATING HYDRAULIC JARRING TOOL

[75] Inventor: James R. Blanton, Dallas, Tex.

[73] Assignee: Dresser Industries, Inc., Dallas, Tex.

[21] Appl. No.: 949,350

[22] Filed: Oct. 6, 1978

[51] Int. Cl.[2] ..... E21B 31/00

[52] U.S. Cl. ..... 175/297

[58] Field of Search ..... 175/296, 297

[56] References Cited

U.S. PATENT DOCUMENTS

| | | | |
|---|---|---|---|
| 2,896,917 | 7/1959 | McGarrahan | 175/297 |
| 2,989,132 | 6/1961 | Downen | 175/297 |
| 3,209,843 | 10/1965 | Webb | 175/297 |

*Primary Examiner*—James A. Leppink

*Attorney, Agent, or Firm*—Fred A. Winans; Eddie E. Scott

[57] ABSTRACT

A hydraulic jarring tool is provided that vents pressure slowly from the tool's internal operating fluid chamber to allow maximum filling of the tool prior to the tool's entering a well and to provide for operating fluid expansion with temperature increases. The jarring tool includes an outer member and an inner member telescopically arranged. Spline means between said outer member and said inner member transmit torque. A hammer and anvil system provide a jarring effect upon actuation of the tool. An operating fluid is maintained in an operating fluid chamber between the outer and inner members. Seal means between the outer and inner members provides a fluid seal to contain the operating fluid. The seal means includes a seal and thermal relief valve assembly mounted for axial travel between said inner member and said outer member with a passage extending therethrough. A thermal relief valve means in the passage provides pressure equalization. The thermal relief valve means provides a controlled flow of operating fluid from the operating fluid chamber to relieve excessive fluid pressure without undue loss of operating fluid.

2 Claims, 4 Drawing Figures

TEMPERATURE COMPENSATING HYDRAULIC JARRING TOOL

TECHNICAL FIELD

The present invention relates in general to the art of earth boring and more particularly to a rotary hydraulic jarring tool.

BACKGROUND OF THE INVENTION

During the drilling of an oil or gas well or the like, situations are encountered wherein a component of the drill string becomes lodged in the borehole. It is, of course, necessary to dislodge this component of the drill string in order to continue the drilling operation. A rotary jarring tool is positioned in the drill string to allow the striking of blows to the drill string and the loosening of and dislodging of the stuck portion of the drill string. For example, rotary jarring tools are installed in fishing strings to enable the driller to strike heavy upward blows against an engaged fish to jar it loose from its stuck position. Rotary jarring tools are included in drill strings during testing, coring and wash-over operations to act as safeguards and to provide a system with which to loosen the drill string should it become stuck. The rotary jarring tools include a restraining or detent mechanism which holds the telescopic elements of the jarring tool in a closed position until sufficient upward pull is exerted to trip the restraining mechanism and allow the telescopic elements to rapidly move to their extended position. The force of the upward pull stretches the drill pipe. When the restraining mechanism trips, the upward surge of the drill pipe in returning to its normal length will allow a severe blow to be imparted to the drill string by the jarring tool. Hydraulic jarring tools utilize a hydraulic operating or working fluid and valve system to provide the tripping action.

The jarring tool's seal system includes upper and lower seal assemblies with the working fluid located therebetween. During the drilling operation, elevated temperatures are encountered which causes the working fluid to build up internal pressure and to experience viscosity changes. The seal assemblies and other components of the jarring tool must be protected against the internal pressure buildup caused by increases in temperature. Although the seal assemblies are prelubricated, a portion of an individual seal assembly, particularly the portion of the seal assembly exposed to the mud side of the tool, may lose this prelubrication because of wash-out during tool operations downhole.

DESCRIPTION OF PRIOR ART

In U.S. Pat. No. 2,989,132 to J. L. Downen, patented June 20, 1978, a hydraulic oil well jar is shown. FIG. 3 is an enlarged fragmentary sectional view taken on the line 3—3 of FIG. 1 and illustrates a liquid escape check valve of the invention which is provided in the annular floating seal thereof.

In U.S. Pat. No. 3,209,843 to Derrel D. Webb, patented Oct. 5, 1965, a hydraulic jarring tool with relief valve is shown. A relief valve serves to prevent rupture of the packing means in the tool. The relief valve bleeds fluid from an internal chamber upon an increase in pressure in said chamber beyond a predetermined limit due to an increase in temperature and/or seepage of fluid from the well into the chamber. Rupture of the packing means is prevented and normal operation of the tool is permitted. The relief valve includes a valve seat, a ball valve for engaging said seat, a plug threadedly received in a vent passage, a plunger engaging the ball valve and a compression spring engaging the plunger and the plug. The pressure at which the ball valve will move away from the seat may be varied by adjustment of the plug.

In U.S. Pat. No. 3,898,815 to James W. Young, patented Aug. 12, 1975, a pressure and volume compensating system for reciprocating oilfield drilling tools is shown. The well tool includes an outer member and an inner member telescopically arranged. A spline means between the outer member and the inner member transmits torque. A spring means is positioned between the outer member and the inner member. A first seal means provides a fluid seal between the outer member and the inner member. A second seal means spaced from the first seal means provides a fluid seal between the outer member and the inner member. At least one of the seal means can move axially between the outer member and the inner member. The axial movement of the seal means accomplishes at least two functions. The first function is that as the external pressure increases, the seal means can move inwardly to compress any trapped air to the point that a pressure balance is maintained at all times. The second function is to accommodate variations in volume created by the drive mandrel as it moves axially within the tool housing.

SUMMARY OF THE INVENTION

The present invention provides compensation for pressure differential between the pressure of the working fluid in a jarring tool and the pressure of the borehole fluid surrounding the jarring tool. The jarring tool includes an outer member and an inner member telescopically arranged. Spline means between the outer member and the inner member transmit torque between the two members. The working fluid is retained inside of the jarring tool by first and second seal means. An internal thermal relief valve vents pressure slowly from the jarring tool's internal chamber to allow maximum filling of the tool prior to its entering the borehole, minimum tool size by limiting seal assembly travel and compensation for working fluid expansion and viscosity change with temperature increases. The thermal relief valve bleeds internal pressure slowly but is insensitive to pressure changes during borehole operations. The arrangement of the seal means and thermal relief valve lubricates the portions of the seal body which otherwise is unlubricated due to loss of lubricant from wash-out during tool operation downhole. The above and other objects and advantages of the present invention will become apparent from a consideration of the following detailed description of the invention when taken in conjunction with the accompanying drawings.

DETAILED DESCRIPTION OF THE INVENTION

Figure 1:
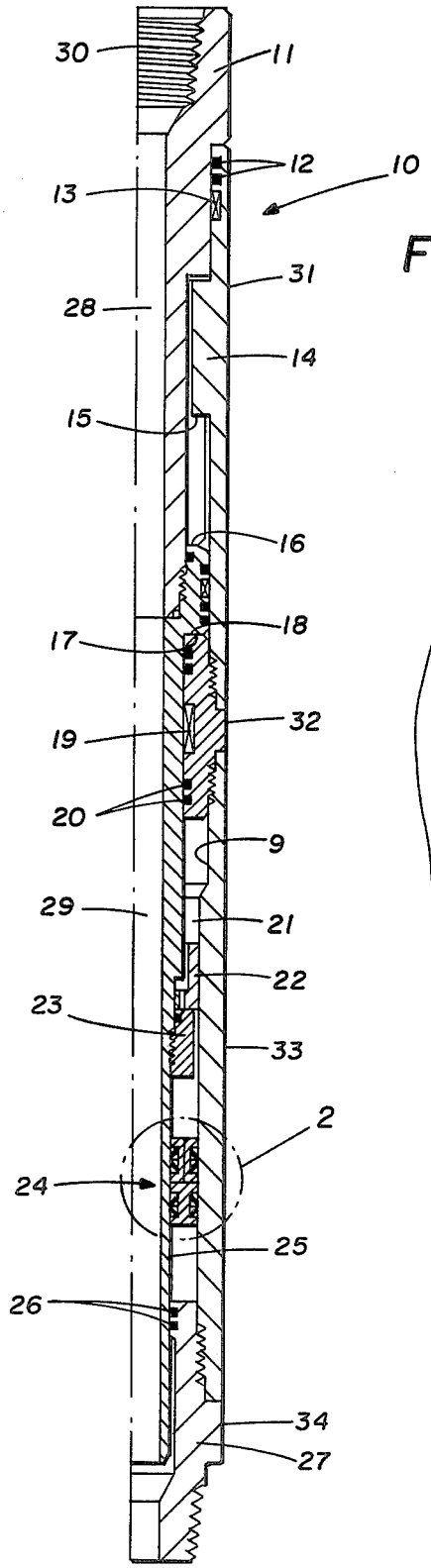
FIG. 1 is a longitudinal view illustrating an embodiment of a jarring tool constructed in accordance with the present invention.

Referring now to the drawings, and in particular to FIG. 1, a hydraulic jarring tool is illustrated therein and generally designated by the reference number 10. Only the right half of the jarring tool 10 is shown, however, it is to be understood that the jarring tool 10 is substantially symmetrical. The jarring tool 10 is an impact tool adapted to be positioned between the lower section of the drill string (not shown) and the upper section of the drill string (not shown) connected with the drilling equipment at the surface. The jarring tool 10 is the type of tool generally called a hydraulic jar.

The hydraulic jar 10 comprises a telescopically arranged inner (upper) mandrel 11 and outer (lower) mandrel 27. The inner mandrel 11 actually comprises two cylindrical, hollow sections, namely the box and spline mandrel section 28 and the piston and wash pipe mandrel section 29. The box connection 30 is provided with an internal thread to be connected to an external thread on the pin end of the drill string component above. The outer mandrel 27 actually comprises four sections, namely the spline mandrel section 31, seal mandrel section 32, piston mandrel section 33 and pin mandrel section 34.

The spline system of the jar 10 comprises spline 14 having radially inwardly directed splines on the inside diameter of the outer spline mandrel section 31 engageable with radially outwardly direct splines on the outside diameter of the inner box and spline mandrel section 28. The spline 14 provides a system for transmitting torque and providing telescoping movement of the inner mandrel 11 and outer mandrel 27. A jarring effect is provided by contact between the hammer 16 and anvil 15 when the jar 10 expands and by contact between the hammer 17 and anvil 18 when the jar 10 contracts. The bearing 19 improves axial movement of mandrels 11 and 27. The wipers 12 and 26 restrict the entry of foreign materials into the working parts of the jar 10.

An annular hydraulic working or operating fluid chamber 21 is provided between inner (upper) mandrel 11 and outer (lower) mandrel 27. An annular sliding sleeve valve or actuation means 22 is disposed in the hydraulic working chamber 21. The sleeve valve 22 is mounted for limited longitudinal movement in chamber 21 and forms a seal between the cylindrical surfaces of the inner and outer mandrels 11 and 27. An annular lower stop member 23 is located below the sleeve valve 22 in the working chamber 21. The sleeve valve 22 acts as a detent or restraining mechanism providing for the slow metering of hydraulic working fluid from the upper chamber portion above the sleeve valve 22 to the lower chamber portion below when the inner mandrel 11 is pulled upwardly relative to the outer mandrel 27 by tensioning the drill string. The fluid is directed through passages in the sleeve valve 22 and the surface of stop member 23. A release section 9 of working fluid chamber 21 is located above sleeve valve 22. When the sleeve valve 22 comes adjacent release section 9 of the chamber 21, the wall friction is reduced. The working fluid still remaining in compression in chamber 21 will be dumped around the sleeve valve 22 and behind the sleeve valve 22 thereby drastically reducing the resistance of working fluid and permitting upward strain on inner mandrel 11 to bring the hammer 16 and anvil 15 into jarring impact.

The lower portion of the working fluid chamber 12 is sealed by a compensator piston type seal and thermal relief valve assembly 24. The lower seal and thermal relief valve assembly 24 comprises a floating temperature and pressure compensating annular seal between the outer mandrel 27 and the washpipe section 25 of the inner mandrel 11. An internal thermal relief valve in assembly 24 vents pressure slowly from the working fluid chamber 21 to allow maximum filling of the jarring tool 10 prior to the tool's entering a well, minimum tool size by limiting seal piston travel and providing for working fluid expansion with temperature increases. The thermal relief valve bleeds internal pressure slowly and is insensitive to pressure changes during borehole operations. The seal and valve assembly system 24 lubricates the portions of the metal bodies which would otherwise be unlubricated due to loss of lubricant by wash-out during tool operations downhole.

Figure 2:
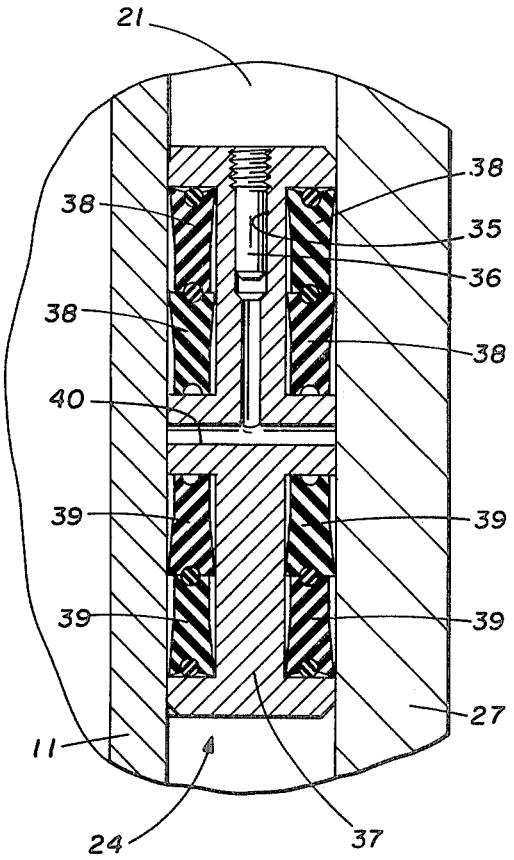
FIG. 2 is an enlarged view of a portion of the jarring tool shown in FIG. 1.

Referring now to FIG. 2, an enlarged view of the seal and thermal relief valve assembly 24 is shown. The assembly 24 includes an annular metal seal body 37 positioned between the inner mandrel 11 and the outer mandrel 27. A series of elastomer seal elements 38 and 39 are positioned in grooves in the metal body 37. The seal and valve assembly 24 can slide axially along the working chamber area 21 to compensate for volume changes created by the telescopic movement of the mandrels 11 and 27 and physical characteristic changes of the working fluid caused by temperature, pressure, etc. A bore 35 extends into the metal body 37 from the working fluid side of the assembly 24. An internal thermal relief valve 36 is positioned in the bore 35. A second bore 40 is connected to the bore 35 and extends radially through the metal seal body 37. The thermal relief valve 36 allows one-way flow of working fluid from within the tool 10 outward but blocks flow in the reverse direction. The valve 36 bleeds internal pressure slowly but is insensitive to pressure changes during the jarring tool's operation. This allows maximum filling of the jarring tool 10 prior to the tool's entering a well. It also reduces tool size by shortening the length of seal piston travel required. The valve 36 allows compensation for lubricant expansion with temperature increases without requiring a greater length of tool.

The seal and thermal relief valve assembly 24 also provides a continuing lubrication system for the metal bodies 11, 27 and 37. The upper seals 38 act as lip seals and provides a more positive seal preventing flow of working fluid downward. The lower seals 39 also act as lip seals and provide a more positive seal preventing flow of fluid upward. The passages 35 and 40 allow the working fluid passing through valve 36 to be directed to the area between the upper seals 38 and lower seals 39. This provides lubrication to the portions of the metal body 37 and mandrels 11 and 27 which otherwise might be unlubricated due to loss of prelubrication. Although the seal assembly 24 is prelubricated at the time of the original construction of the jarring tool 10, this prelubrication may be lost by wash-out during tool operations.

Figure 4:
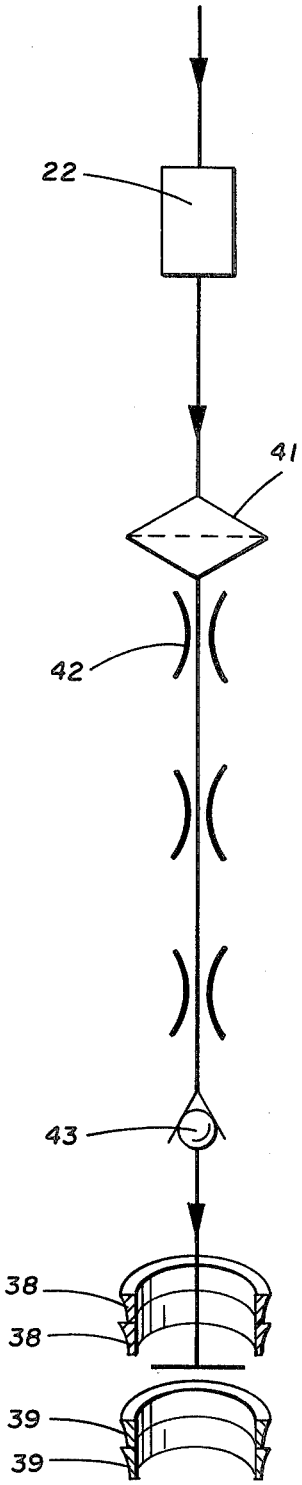
FIG. 4 is a schematic flow diagram illustrating the flow pattern of the operating fluid in the jarring tool of FIGS. 1, 2 and 3.

Referring now to FIG. 4, an illustration of the thermal relief valve 36 is shown. This type of valve is commercially available, for example, a thermal relief insert may be purchased from The Lee Company, 2225 East Randol Mill Road, Arlington, Texas. A series of restrictor orifices 42 in the thermal relief valve create turbulent flow prior to the fluids exit through check valve 43. A filter 41 is located ahead of the orifices. The thermal relief valve 36 allows a small flow of operating fluid out of the system when hermal expansion pressures substantially in excess of normal pressures are developed. The expansion pressure is relieved to the area between the seals 38 and 39. Relieving the pressure minimizes bowing or burst of components of the tool due to high pressure.

Figure 3:
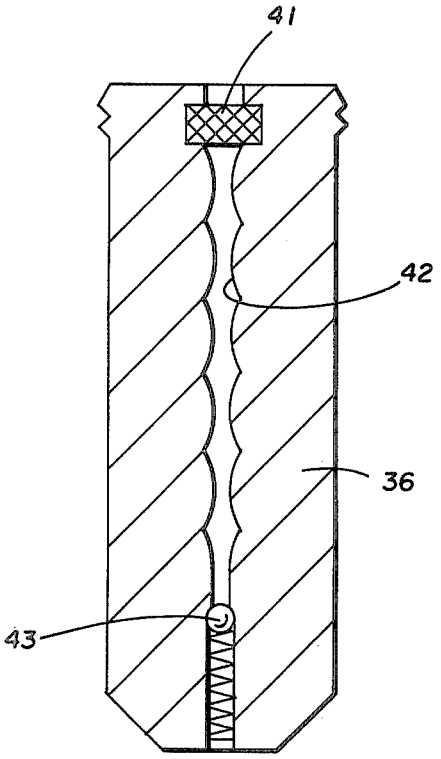
FIG. 3 is an enlarged view of the thermal relief valve assembly included in the jarring tool shown in FIGS. 1 and 2.

The structural details of one embodiment of a jarring tool 10 constructed in accordance with the present invention having been described, the operation of the jarring tool 10 will now be considered with reference to the flow diagram shown in FIG. 4 and to the elements of the drawings shown in FIGS. 1–3. A lower drill string section or borehole tool is attached to the end of lower mandrel 27 at the threaded pin. The box connection on upper mandrel 11 is attached to the upper section of the drill string. The working or operating fluid fills the working chamber 21. The jarring tool 10 and drill string are lowered into the borehole and the borehole operations continue. If a section of the lower drill string or borehole tool becomes tightly wedged in the borehole, a jarring action may be applied through the jarring tool 10 to attempt to dislodge the stuck portion.

The jarring tool 10 is initially in a fully contracted condition. An axial force is applied to the inner mandrel 11 through the drill string. This puts the working fluid into compression. The only way to relieve the internal pressure in the working fluid is through the sleeve valve 22. A small portion of working fluid will pass through the sleeve valve 22 into that portion of working fluid chamber 21, which is between sleeve valve 22 and the seal and valve assembly 24. The sleeve valve 22 will rise, relatively, in working fluid chamber 21 at an extremely slow speed. When the sleeve valve 22 comes adjacent release section 9 of the chamber 21, the wall friction is reduced. The working fluid still remaining in compression in chamber 21 will be dumped around the sleeve valve 22 and behind the sleeve valve 22 thereby drastically reducing the resistance of working fluid and permitting the upward strain to bring the hammer 16 and anvil 15 into a jarring impact. The jarring effect is transmitted through outer mandrel 27 to the stuck portion which might then be dislodged. To reset the jarring tool 10, it is only necessary to allow the weight of the drill string above to be set down on the jarring tool 10. Working fluid travels into the portion of working chamber 21 located above sleeve valve 22. Once the contraction is fully complete, the jarring tool 10 is ready to deliver another blow when required.

During the jarring tool's operation, the seal and thermal relief valve assembly 24 tend to float toward the bottom end of the tool. At jarring, it will occilate back and forth. Under some circumstances, the assembly 24 will bottom out. Should the tool 10 encounter elevated temperatures with the assembly 24 bottomed out, dangerously high pressure could be produced in the working fluid. The thermal reliif valve 36 will allow a small flow of operating fluid out of the system when thermal expansion pressures substantially in excess of normal pressures are developed. Since the viscosity of the operating fluid changes with temperature, controlled flow is important to prevent loss of excessive amounts of operating fluid. The pressure will be relieved by flow through screen 41, orifices 42, and one-way valve 43 to the area between the seals 38 and 39.

The embodiments of the invention in which an exclusive property or privilege is claimed are defined as follows:

1. A hydraulic jarring tool, comprising:
an outer member;
an inner member, said outer member and said inner member being telescopically arranged;
spline means between said outer member and said inner member for transmitting torque;
an anvil and hammer means for providing a jarring effect;
an operating fluid chamber between said inner member and said outer member containing operating fluid;
detent means for actuating said anvil and hammer means; and
seal means between said outer member and said inner member for providing a fluid seal to contain said operating fluid, said seal means including a seal and thermal relief valve assembly mounted for axial travel between said inner member and said outer member, said assembly comprising an annular seal body with a pair of inner seal rings mounted between said inner member and said annular seal body defining an inner chamber and a pair of outer seal rings mounted between said annular seal body and said outer member defining an outer chamber with a passage means extending from said operating fluid chamber to said inner chamber and said outer chamber and thermal relief valve means in said passage means for providing pressure equalization, said thermal relief valve means actuated at a preselected pressure and operating to allow limited flow of operating fluid out of said operating fluid chamber into said inner chamber and outer chamber and blocking flow into said operating fluid chamber.

2. A hydraulic jarring tool, comprising:
an outer member;
an inner member, said outer member and said inner member being telescopically arranged;
spline means between said outer member and said inner member for transmitting torque;
an anvil and hammer means for poviding a jarring effect; an operating fluid between said inner member and said outer member;
detent means for actuating said anvil and hammer means; a first seal element between said outer member and said inner member for providing a fluid seal to contain said operating fluid;
a second seal element between said outer member and said inner member for providing a fluid seal to contain said operating fluid, said second seal element including an annular seal body mounted for axial travel between said inner member and said outer member with a pair of inner seal rings mounted on said annular seal body between said inner member and said annular seal body and a pair of outer seal rings mounted on said annular seal body between said annular seal body and said outer member, said pair of inner seal rings defining an inner chamber and said pair of outer seal rings defining an outer chamber;
passage means extending through said annular seal body from a position proximate said operating fluid to said inner chamber and said outer chamber; and
thermal relief valve means in said passage means for providing pressure equalization, said thermal relief valve means actuated at a preselected pressure and operating to allow flow of operating fluid out of said jarring tool into said inner chamber and said outer chamber and blocking flow back into said jarring tool.

* * * * *